United States Patent [19]

Hathaway et al.

[11] Patent Number: 4,783,900

[45] Date of Patent: Nov. 15, 1988

[54] METHOD OF CONTINUOUSLY PRODUCING RAPIDLY SOLIDIFIED POWDER

[75] Inventors: Robert E. Hathaway, Dover; Edward M. Norin, Pompton Plains, both of N.J.

[73] Assignee: Allied-Signal Inc., Morris Township, Morris County, N.J.

[21] Appl. No.: 944,719

[22] Filed: Dec. 22, 1986

Related U.S. Application Data

[62] Division of Ser. No. 336,657, Jan. 4, 1982, Pat. No. 4,650,130.

[51] Int. Cl.[4] ..... B22D 11/126

[52] U.S. Cl. ..... 29/527.6; 164/462; 164/463

[58] Field of Search ..... 29/527.4, 527.5, 527.6, 29/527.2, 527.1, 527.7; 241/23, 101.1, 101.4, 101.2; 75/0.5 C, 0.5 R; 164/462, 463, 460, 476, 477, 423

[56] References Cited

U.S. PATENT DOCUMENTS 3,713,477 1/1973 Kuniyasu et al. ..... 164/460
3,852,060 12/1974 Leavenworth, Jr. et al. ... 419/24 X
4,408,653 10/1983 Nienart et al. ..... 164/463

FOREIGN PATENT DOCUMENTS 55-82702 6/1980 Japan ..... 75/0.5 B

*Primary Examiner*—Howard N. Goldberg
*Assistant Examiner*—Carl J. Arbes
*Attorney, Agent, or Firm*—Gus T. Hampilos

[57] ABSTRACT

A system is described for the production of rapidly solidified powder. The system contains elements for casting rapidly solidified ribbon, an in-line knife mill or a hammer mill for fracturing the rapidly solidified ribbon into shard, and either an in-line fluid energy mill, or an in-line centrifugal mill for reducing the shard to powder. The system can effectively reduce ribbon to powder in an in-line operation, and produce a powder with a particle size of -31 35 mesh. A method employing the system is also described.

1 Claim, 1 Drawing Sheet

METHOD OF CONTINUOUSLY PRODUCING RAPIDLY SOLIDIFIED POWDER

This application is a division of application Ser. No. 336,657 filed Jan. 4, 1982 now U.S. Pat. No. 4,650,130 issued 3/17/87.

FIELD OF THE INVENTION

The present invention relates to a method and a system for the production of rapidly solidified powder, and more particularly to a method and a system which casts ribbon and reduces the ribbon to powder in an in-line operation.

BACKGROUND ART

Rapidly solidified powder has been produced by atomization techniques such as those described in U.S. Pat. No. 3,856,513. Powder produced by these techniques has a distribution in particle size, this variation in particle size gives rise to a variation in the cooling rate experienced by the particles, since the larger the particle the slower the particle cools.

More rapid quenching rates than obtained by atomization techniques may be obtained by splat quenching, such as taught in U.S. Pat. No. 4,221,587. Splat quenching, although in general, providing more cooling than the atomization techniques, produces powders where some of the powder has experienced different cooling rates.

More uniformly cooled powder quenched at the high rate associated with splat quenching techniques can be obtained by casting ribbon and subsequently fracturing it to form powder. Methods for reduction of ribbon to powder are taught in U.S. Pat. No. 4,290,808, however, these methods are not capable of a throughput of ribbon which is compatible with the output from a ribbon casting operation For this reason the methods of the 4,290,808 patent are not well suited for integration into an in-line operation which produces ribbon that is to be converted to powder.

SUMMARY OF THE INVENTION

A system is set forth for in-line production of powder from cast ribbon. A crucible is provided for containing a bath of molten metal. A heating means provides heat to the molten metal. A nozzle is attached to the crucible through which the molten metal passes forming a stream of molten metal. A moving chill surface is in close proximity to the nozzle for solidifying the stream of molten metal to form a continuous ribbon.

Means for forming shards is provided which receives the ribbon and breaks it into shard. The means compatible with the rate of ribbon formation on a moving chill surface is either a hammer mill or a knife mill.

In-line means are provided which accept the shard, and reduce the shard to powder. These means may be either a fluid energy mill, or a centrifugal impact mill.

BRIEF DESCRIPTION OF THE FIGURE

The FIGURE of the drawing is a schematic representation of a casting and powder making system of the present invention.

BEST MODE FOR CARRYING THE INVENTION INTO PRACTICE

Figure 1:
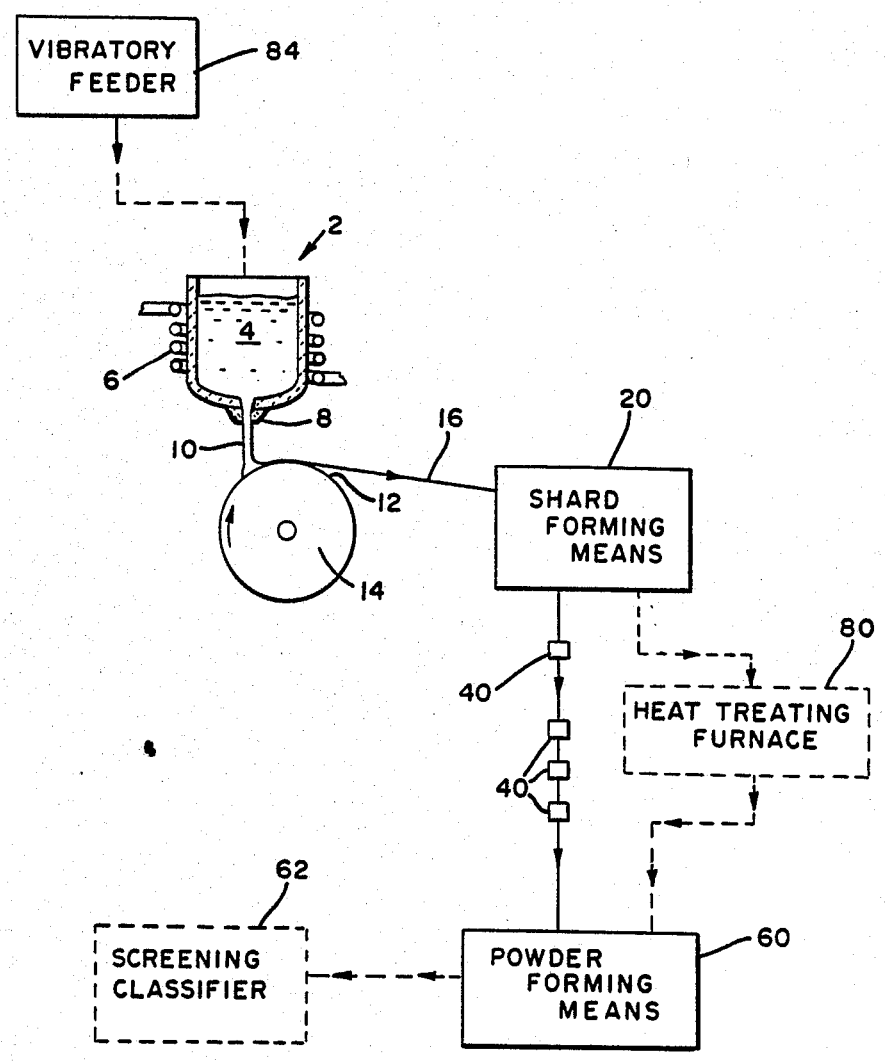

FIG. 1 is a schematic representation of a casting system suitable for practicing the present invention. A crucible 2 contains a bath of molten metal 4. The molten metal 4 is heated by a heating means, such as an induction coil 6. It is preferred that the crucible 2 be a bottom pour crucible having a nozzle 8 attached to the crucible 2. The nozzle 8 provides a stream of molten metal 10 which impinges onto a moving chill surface 12. The nozzle 8 may, in the case of a jet casting system, as is illustrated in FIG. 1, be substantially separated from the chill surface 12, this allows the stream of molten metal 10 to fully develop. When a planar flow nozzle is employed the nozzle 8 will be in close proximity to the chill surface 12 to develop an extended puddle between the nozzle 8 and the chill surface 12. Further details of the planar flow casting nozzle are set forth in U.S. Pat. No. 4,142,571 which is incorporated herein by reference.

The moving chill surface 12 may be the peripheral edge of a rotating wheel 14, as is illustrated in FIG. 1, or the moving chill surface 12 may be the surface of a continuous belt as is disclosed in U.S. Pat. No. 4,142,571. When either of the chill surfaces is used in practicing the present invention a continuous ribbon 16 is formed which is fed to means for forming shard 20. A variety of devices are available for pulverization of ribbon such as a hammer mill, belt mill, knife mill, impact mill, fluid energy mill etc., however it has been found that the the only mill which effectively breaks ribbon in an in-line operation is a hammer mill, or a knife mill. Furthermore it has been found that these two mills can process the ribbon without substantial wear to the mill. Since the mill does not wear the shard produced is free from contamination. It is also preferred that the cutting surfaces of the mill are a material harder than the ribbon which is being cut. The cutting surface maybe made from a material such as tungsten carbide, silicon carbide, or hardened tool steels.

The mill processing ribbon 20 to form shard must be able to process ribbon which is entering the mill at a minimum linear velocity of about 1000 fpm (508 cm/s).

For ductile materials, such as those that can bend over themselves without fracture, the knife mill is preferred. This mill has the advantage that it produces shard of more uniform size. A detailed discussion of knife mills is contained in "Crushing and Grinding" by George Charles Lowrison, CRC Press.

For brittle materials it is preferred to use a rotary hammer mill. For hard materials it is preferred to use a jump gap or wedge wire screen with the hammer mill to minimize screen and mill wear.

Further discussion on rotary hammer mills is contained in the work by George Charles Lowrison. In these mills tool steel breaking surfaces used in combination with a tungsten carbide hammer has been found effective for reducing wear. When contamination of the powder with traces of iron oxide may be a problem, it is preferred to use stainless steel breaking surfaces. To limit wear the maximum rotation speed should produce a peripherial speed of the hammer of below about 75 m/sec.

Employing either, a knife mill, or a hammer will allow continuous ribbon 16 to be fractured into shard 40 with an average maximum dimension of about 0.25 inch (0.635 cm) by 0.125 inch (0.317 cm). In general, the shard 40 produced by a knife mill will be more uniform in size than the shard 40 produced by a rotary hammer mill. Furthermore, when a wide ribbon, such as produced on a planar flow caster, is employed the knife mill is preferred.

Means for forming powder 60, convert the continuously generated shard 40 from the shard forming means 20 into powder. It has been found that of the above mentioned pulverizing devices only the centrifugal mill and the fluid energy mill have sufficient capacity to reduce shard to powder of −35 mesh in an in-line operation.

Further details of the fluid energy mill are contained in the work by George Charles Lowrison. It has been found that the cylinderical fluid energy mill is more wear resistant when processing shard of rapidly solidified material than the torus type fluid energy mill. For hard or abrasive materials, he mill should have suitable liners, such as urethane, tungsten carbide, or silicon carbide, or in the alternative suitable hardfacing with a material such as a Stellite ® alloy, tungsten carbide, or titanium carbide.

Centrifugal mills operate by spinning shard in a radial tract to accelerate the shard. The accelerated shard impacts a stationary surface and in so doing is fractured. One effective centrifugal mill for fracturing shard is produced by Vortec Products Company, Long Beach, Calif.

In general, when a hammer mill produces shard it is preferred that a fluid energy mill be employed to break the shard into powder, since the fluid energy mill effectively operates with a broader range of shard sizes than would the centrifugal mill. The centrifugal mill, however, is more energy efficient, and operates well in combination with a knife mill.

The powders produced by either of the powder producing mills may be sized by a screening classifier 62 to develop a particular classification of powder size.

Amorphous cast ribbon is in general ductile, and not readily fractured. The amorphous ribbon can be made brittle by adjusting the speed of the wheel 14 so as to produce a shorter dwell time of the ribbon 16 on the surface of the wheel 12. This will cause the ribbon 12 to be rejected from the wheel while the ribbon is still hot, and in so doing allows the ribbon to self anneal and embrittled before entering the shard forming means 20.

By the above procedure it is possible to make amorphous ribbon sufficiently brittle that it can be processed by a hammer or a knife mill, and provide a throughput which is compatable with the ribbon caster. In the event that additional heat treatment is desirable to further embrittle the shard to facilitate further fracturing, a means for heating the shard such as a furnace 80, may be employed to anneal the shard before it is broken into powder The shard 40 can be annealed by directing it into a batch furnace, or by passing the shard through a conveyor furnace A more complete discussion of heat treating to embrittle an amorphous material is contained in U.S. Pat. No. 4,290,808 incorporated herein by reference.

When it is desired to extend the duration of the run supplimentary metal can be added to the bath of molten metal 4 either in solid or liquid form. The supplementary metal may be charged in a separate holding furnace and brought to temperature before adding to the bath of molten metal 4, or alternatively solid pellets of metal maybe added to the bath of molten metal 4 by a vibratory feeder 84.

EXAMPLE I

An alloy of $Ni_{56.5}Fe_{10}Mo_{23.5}B_{10}$ (subscripts represent atomic percents) was induction melted in a stabilized refractory crucible. The crucible was a botton pour crucible having a nozzle diameter of 0.05 inch (0.127 cm). The alloy was cast onto a water cooled 12 inch (30.5 cm) diameter Cu-Be wheel. The speed of the casting surface was 5000 ft/min (2540 cm/s) and produced an amorphous ribbon with a width of approximately 0.08 inch (0.203 cm). The output of the casting operation under the above conditions was 150 lbs/hr (68.18 kg/hr).

EXAMPLE II

Ribbon produced as described in Example I was reduced to shard with a model "A" Type GF Pulva hammer mill produced by Pulva Corporation. The hammer mill was fitted with a jump gap screen having openings about 0.25 inch (0.63 cm) by 3.5 inch (8.89 cm). The tip speed of the hammers was 35 m/sec. The throughput of the hammer mill was 150 lbs/hr (68.18 kg/hr), and produced shard having lengths between about 0.25 inch (0.63 cm) and 1.5 inch (2.8 cm).

EXAMPLE III

Shard produced by the hammer mill of Example II was heat treated for two hours at 500° C. The shard was reduced to powder in a cylindrical fluid energy mill. The mill was a 6 inch (15.24 cm) in diameter tungsten carbide lined Micro-Jet mill with the motive force produced by 67 SCFM of 90-100 psig (225-800 kPa absolute) of oil free air. The mill reduced the shard to powder having an average particle size of 275 μm. The through put of the mill was 19 lbs/hr.

EXAMPLE IV

Ribbon produced as described in Example I was reduced to shard with a model SCC-10, 10" knife mill produced by Munson Machinery Co., Inc. The knife mill was operated at 2400 rpm and generated shard which was more uniform in length than the shard generated with the hammer mill of Example II. The shard had a nominal length of 0.25 inch (0.635 cm). The throughput was 150 lbs/hr (68.18 kg/hr).

EXAMPLE V

The shard produced by the knife mill described in Example IV was reduced to powder with a centrifugal impact mill. The mill was a model M-12 manufactured by Vortec Products Company. The average particle size was 255 μm and the throughput was 92 lbs/hr (41.8 kg/hr).

EXAMPLE VI

The shard produced by the knife mill described in Example IV was heat treated for two hours at 500° C. before pulverization in the centrifugal mill described in Example V. The average particle size was 90 μm and the throughput was 400 lbs/hr.

What we claim is:

1. A method for continuously producing rapidly solidified powder, the method comprising the steps of:

(a) casting liquid metal onto a rapidly moving chill surface to produce a rapidly solidified continuous ribbon;

(b) continuously feeding said rapidly solidified continuous ribbon from said chill surface to means for forming shard;

(c) forming shard from said rapidly solidified continuous ribbon;

(d) continuously feeding said shard to means for producing powder; and, (e) forming powder from said shard.

* * * * *